US006722432B2

(12) United States Patent
Spiers et al.

(10) Patent No.: US 6,722,432 B2
(45) Date of Patent: Apr. 20, 2004

(54) SLIMHOLE FLUID TESTER

(75) Inventors: Christopher W. Spiers, Sugar Land, TX (US); Dinesh R. Patel, Sugar Land, TX (US); Anthony P Vovers, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/058,593

(22) Filed: Jan. 28, 2002

(65) Prior Publication Data

US 2002/0100585 A1 Aug. 1, 2002

Related U.S. Application Data

(60) Provisional application No. 60/264,753, filed on Jan. 29, 2001.

(51) Int. Cl.[7] ..... E21B 47/00; E21B 49/08

(52) U.S. Cl. ..... 166/264; 166/381; 175/59

(58) Field of Search ..... 166/264, 381, 166/162, 169; 175/58, 59

(56) References Cited

U.S. PATENT DOCUMENTS 3,107,730 A * 10/1963 Lebourg ..... 166/100
3,253,654 A * 5/1966 Briggs, Jr. et al. ..... 166/100
3,294,170 A * 12/1966 Warren et al. ..... 166/100
3,305,014 A * 2/1967 Brieger ..... 166/264
4,690,216 A * 9/1987 Pritchard, Jr. ..... 166/264
5,103,906 A * 4/1992 Schultz et al. ..... 166/164
5,540,280 A * 7/1996 Schultz et al. ..... 166/250.07
5,799,733 A * 9/1998 Ringgenberg et al. ..... 166/264
5,803,186 A * 9/1998 Berger et al. ..... 175/50
6,006,834 A * 12/1999 Skinner ..... 166/250.17
6,047,239 A * 4/2000 Berger et al. ..... 702/9
6,092,416 A * 7/2000 Halford et al. ..... 73/152.23
6,157,893 A * 12/2000 Berger et al. ..... 702/9
6,446,719 B2 * 9/2002 Ringgenberg et al. . 166/250.12

* cited by examiner

*Primary Examiner*—David Bagnell
*Assistant Examiner*—Jennifer H Gay
(74) *Attorney, Agent, or Firm*—Trop, Pruner & Hu P.C.; Jeffrey Griffin; Brigitte Jeffery Echols

(57) ABSTRACT

A tool that is usable in a subterranean well to sample well fluid from a zone does not include a pump to remove well fluid from the zone for purposes of sampling. Instead, the tool includes a flow path that is in communication with the zone and a region of the well above the zone to use a pressure differential created or naturally occurring between the zone and the region of the well above the zone to flow well fluid from the zone. The tool may also include a flow path that is in communication with the region of the well above the zone and the region of the well below the zone to equalize pressure along the tool and thereby prevent unintended axial movement of the tool. A fluid sampler of the tool samples a composition of the well fluid from the zone.

21 Claims, 3 Drawing Sheets

SLIMHOLE FLUID TESTER

The invention claims the benefit under 35 U.S.C. § 119 to U.S. Provisional Patent Application Serial No. 60/264,753, filed on Jan. 29, 2001.

BACKGROUND

The invention generally relates to a slimhole fluid tester.

For purposes of producing a well fluid (methane, for example) from one or more subterranean formations, the formation(s) may be drilled to create a well bore that extends through the formations(s). The well bore may be cased with a steel casing.

It is common for the well bore to pass through several regions, or zones, of the well, each of which contains a particular well fluid. As an example, some zones may contain carbon dioxide, some zones may contain hydrogen sulfide and some zones may contain methane. Therefore, to produce methane, for example, it is desirable to produce from the zones that primarily contain methane and avoid producing from the zones that primarily contain hydrogen sulfide and carbon dioxide, as examples. In this manner, once production begins, the zones may be isolated by packers so that primarily the desired well fluid is produced.

Before production begins, however, a perforating gun typically is lowered downhole to pierce the well casing and form perforation tunnels in the formation(s) at various sites along the wellbore for purposes of enhancing and/or allowing the production of well fluids from the formation. In this manner, typically, the perforating gun is part of a perforating gun string, an assembly that may include several perforating guns that are located at different depths. The perforating gun string typically is positioned downhole via a wireline or coiled tubing (as examples) until the perforating gun string is at the desired depth. The perforating guns are then fired to perforate the formation(s) at several sites.

After perforation, the well may then be tested to determine the composition of the well fluids that are associated with the various zones of the well. In this manner, a testing tool, or tester, may be lowered downhole to test the different zones of the well. The tester typically includes packers to seal off and thus, isolate the different zones so that well fluids from the different zones may be sampled by the tester.

However, before the packers are set to isolate the different zones, the fluids from the different zones may intermingle, and thus, once the packers of the tester are set, a particular sealed zone may initially contain a mixture of fluids from other zones. Therefore, to obtain an accurate sample of the fluid in a particular zone, the tester may include a pump to remove fluid from the particular zone before the sample is taken. This removal of fluid ideally flushes the intermingling fluids from the zone, leaving the fluid produced by the zone being tested. However, for a well bore that has a small diameter (a diameter of approximately 2⅞ inches, as an example), otherwise known as a slimhole, the pump may be too large to be used in the well bore.

Thus, there is a continuing need for an arrangement that addresses one or more of the problems that are stated above.

SUMMARY

In an embodiment of the invention, a tool that is usable in a subterranean well to sample well fluid from a zone does not include a pump to remove well fluid from the zone for purposes of sampling. Instead, the tool includes a flow path that is in communication with the zone and a region of the well above the zone to use a pressure differential created or naturally occurring between the zone and the region of the well above the zone to flow well fluid from the zone. The tool may also include a flow path that is in communication with the region of the well above the zone and the region of the well below the zone to equalize pressure along the tool and thereby prevent unintended axial movement of the tool. A fluid sampler of the tool samples a composition of the well fluid from the zone.

Advantages and other features of the invention will become apparent from the following description, drawing and claims.

DETAILED DESCRIPTION

Figure 1:
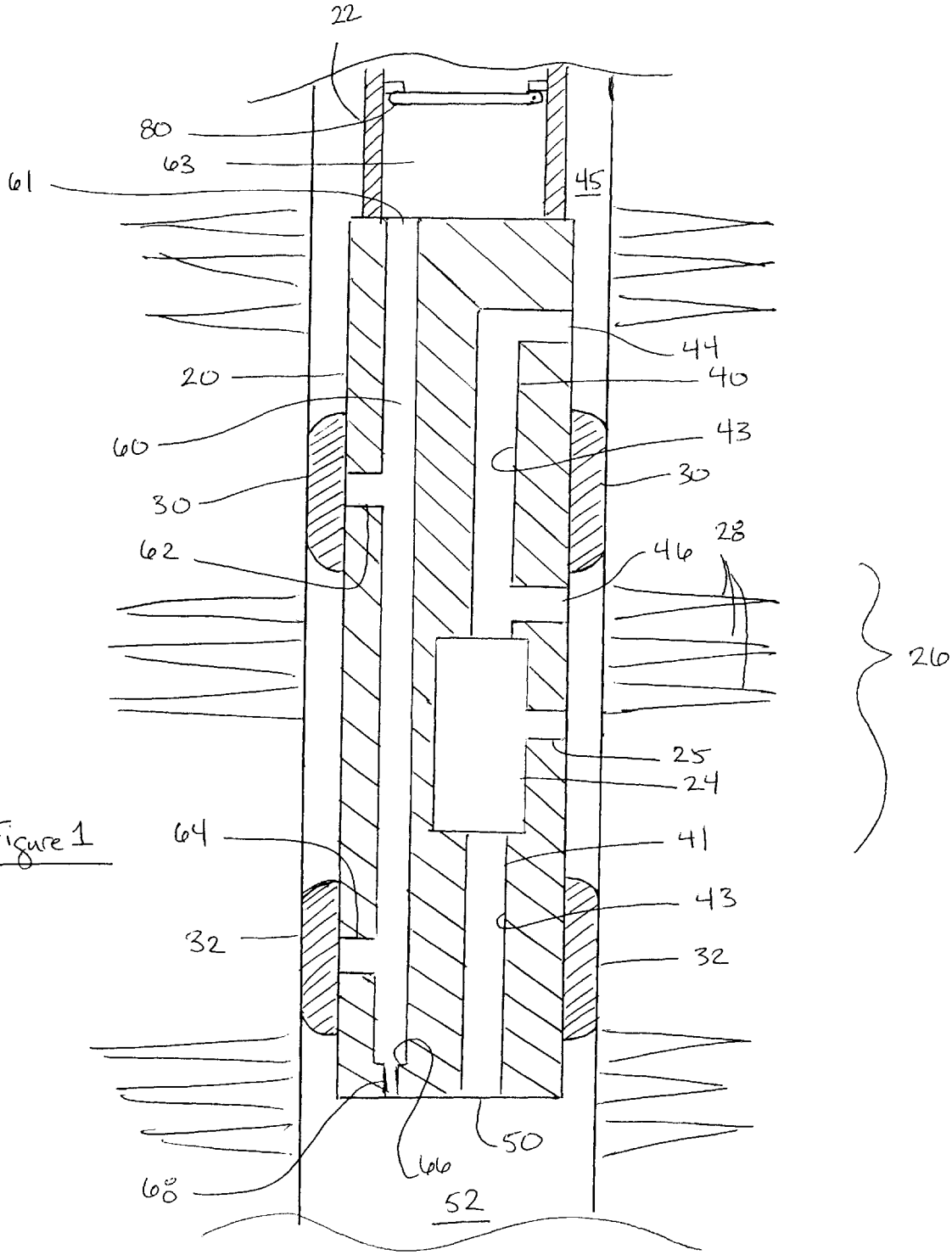
FIGS. 1–3 are schematic diagrams of a downhole tool in accordance with different embodiments of the invention.

Referring to FIG. 1, an embodiment 20 of a fluid testing tool in accordance with the invention may be run downhole in a well bore (a cased well bore or an uncased wellbore) to sample the fluids produced by different zones of a subterranean well. As an example, the tool 20 may be run downhole on coiled tubing 22 after a perforating gun string (not shown) forms perforation tunnels in formation(s) that surround the well bore. For example, a gun of the perforating gun string may form perforation tunnels 28 in an exemplary zone 26 that is depicted in FIG. 1. For purposes of sealing off a particular zone for testing, the tool 20 includes packers, such as an upper packer 30 and a lower packer 32. For example, to test the zone 26, the tester 20 is operated (as described below) to set the upper packer 30 to seal off the annulus above the zone 26 and set the lower packer 32 to seal off the annulus below the zone 26. In this manner, after the zone 26 is isolated, the tool 20 may sample well fluid from the zone 26 for purposes of determining the fluid's composition. For cased well bores, the upper 30 and lower 32 packers straddle perforation holes in the casing. For uncased well bores, the upper 30 and lower 32 packers straddle a particular production zone.

Because the fluid in the zone 26 initially contains a mixture of well fluids from other zones of the well, after setting the packers 30 and 32 and before sampling, the tool 20 flushes out any fluid that is not part of the zone by flowing fluid from the zone 26 to a region of the annulus outside of the zone 26.

In the context of this application, the phrase "well fluid" refers to both a fluid of a single composition as well as a mixture of specific well fluids, such as carbon dioxide, hydrogen sulfide and methane, as just a few examples.

Referring now to more specific details of the tester 20, in some embodiments of the invention, for purposes of flushing well fluid from a particular zone being tested, the tool 20 includes a flow path 40 (formed in a body of the tool 20) that extends from a region 45 above the tool 20 (between the tool 20 and the well casing or wellbore), through the upper packer 30, and to the zone 26. The test flow path 40 includes a radial inlet port 46 that receives well fluid from the zone 26 and a radial outlet port 44 that delivers well fluid into the annular region 45.

The fluid sampler 24 samples the fluid from the zone 26 (via a radial port 25 that extends into the zone 26) after the test flow path 40 sufficiently circulates fluid out of the zone 26 to derive an accurate sample. Although the sampler 24 is shown superimposed on the test flow path 40 (and/or equalizing flow path 41), it is understood that the sampler 24 typically is not in fluid communication with the test flow path 40 or the equalizing flow path 41. The fluid sampler 24 may be, as an example, a timed sampler that measures a time interval after the packers 30 and 32 set, and after the expiration of the time interval, the fluid sampler 24 takes a sample of the fluid in the zone 26. As another example, the fluid sampler 24 may be a remotely controlled, or remotely operable, sampler that is operated from the surface of the well. For example, after an operator at the surface of the well determines that the fluid has flowed for a sufficient time to obtain an accurate sample, the operator may operate surface equipment to generate a stimulus (a pressure pulse, for example) that propagates downhole. The sampler 24 responds to the stimulus by sampling the fluid that flows from the zone 26. As an example, the stimulus may propagate through a central passageway 63 of the coiled tubing 22 to the tool 20. Other techniques may be used.

Figure 2:
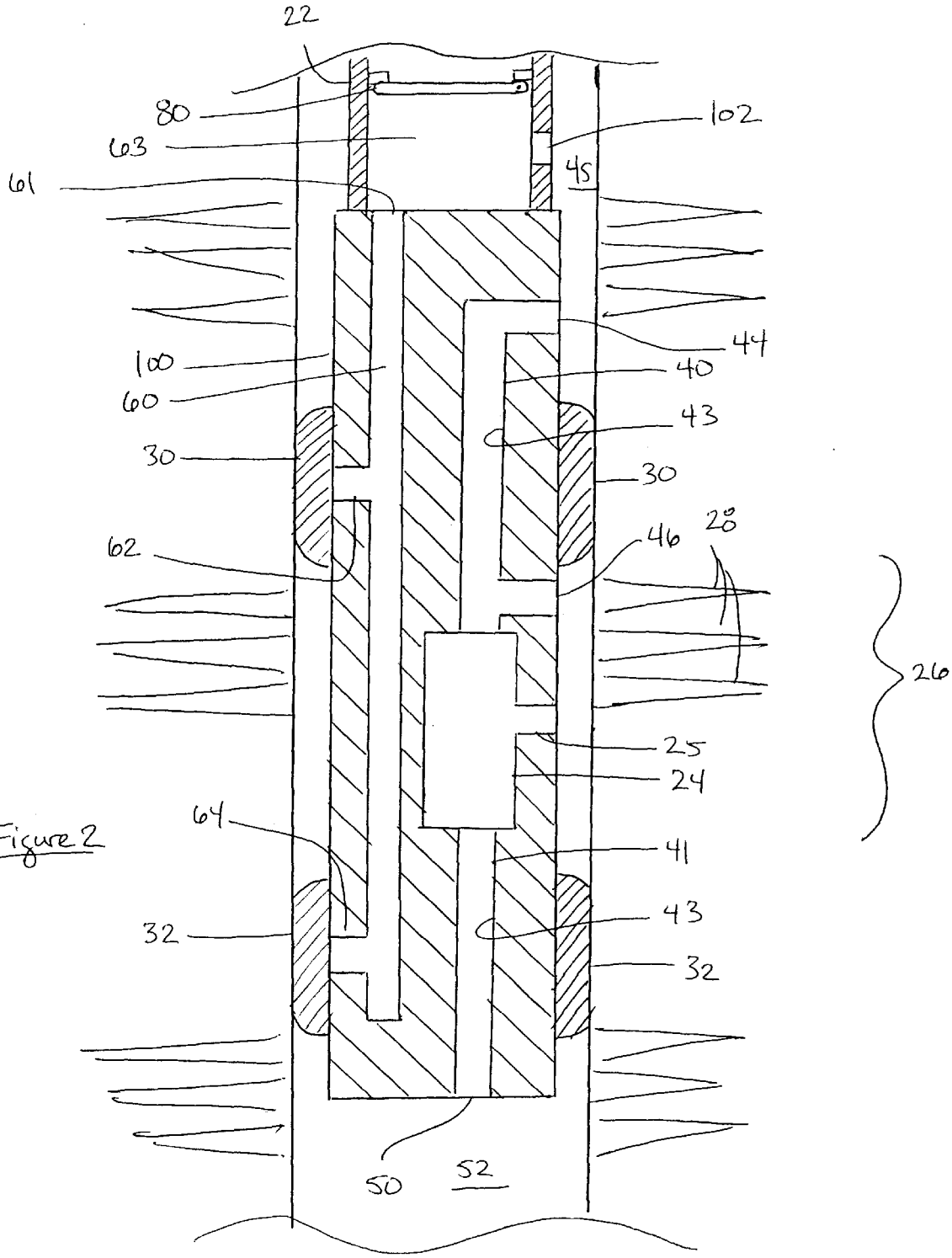
Figure 3:
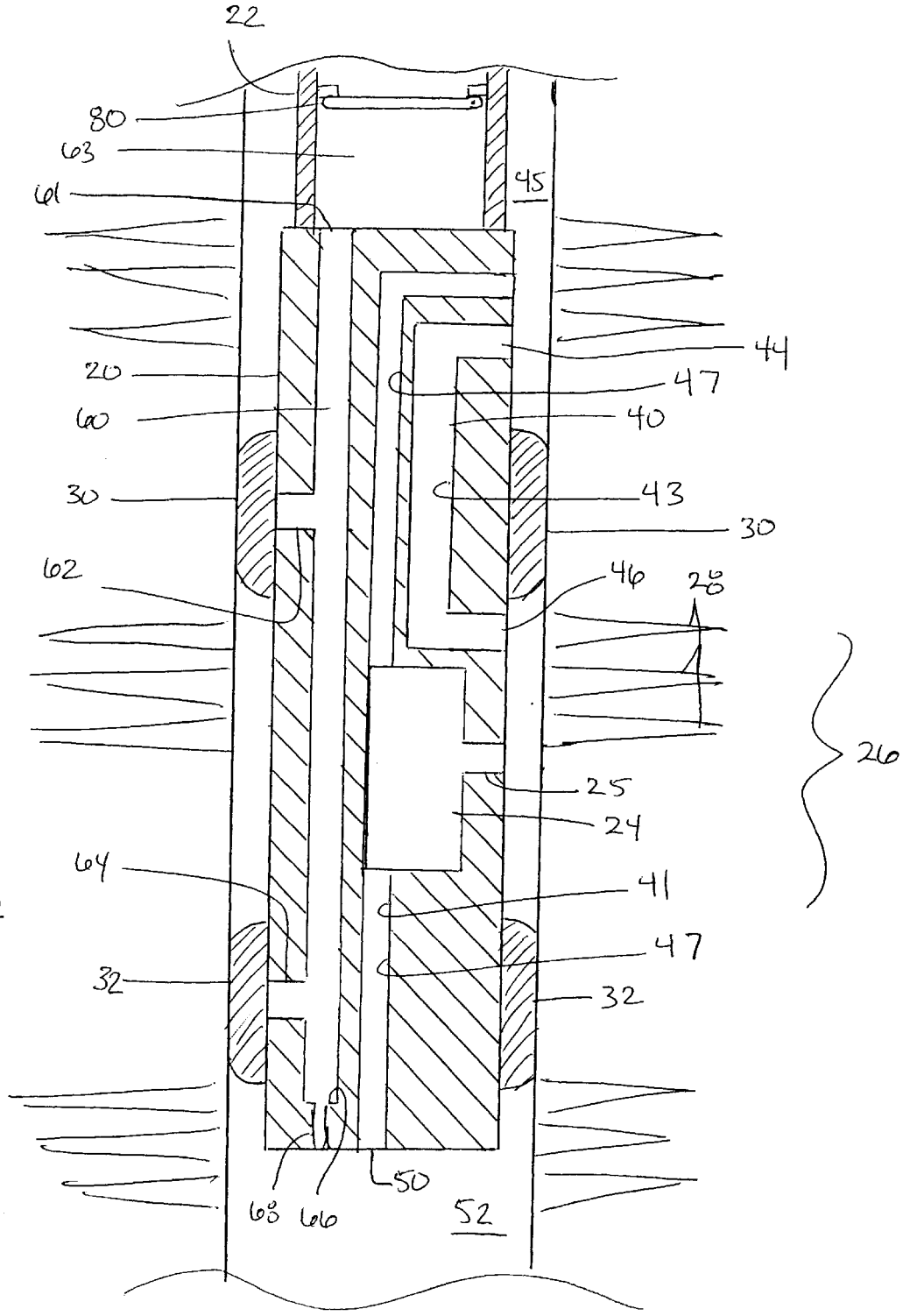

In some embodiments, the tool 20 may also include an equalizing flow path 41 to equalize the pressure along the tool 20 (and particularly across the packers 30,32) so as to prevent the unintended axial movement of the tool 20. Equalizing flow path 41 may extend and provide fluid communication between the region 45 above the tool 20 and the region 52 below the tool 20. Thus, equalizing flow path 41 passes through the lower packer 32 and the upper packer 30 and includes an inlet port 50 that communicates with the region 52 below the tool 20. In one embodiment as shown in FIGS. 1 and 2, equalizing flow path 41 is in fluid communication with test flow path 40 so that each of the radial outlet port 44, radial inlet port 46, and inlet port 50 are in fluid communication with the same passageway 43 through tool 20. In another embodiment as shown in FIG. 3, equalizing flow path 41 and test flow path 40 are independent from and do not communicate with each other, the test flow path 40 being defined by a first passageway 43 through tool 20, and the equalizing flow path 41 being defined by a second passageway 47 through tool 20. In operation, once the upper and lower packers 30,32 are set, the equalizing flow path 41 equalizes the pressure between the annular region 45 and the region 52 below the tool 20 (across upper and lower packers 30,32) thereby preventing the axial movement of the tool 20.

It is noted that the tool 20 does not include a pump to assist the flow of well fluid from the zone 26 and through the flow path 40. Instead, a passive approach is used in which a pressure differential is established between the zone 26 and the annular region 45. In this manner and in one embodiment, the zone 26 has a positive pressure so that this wellbore positive pressure induces a flow through the test flow path 40 from the inlet 46 to the outlet 44. The pressure differential between zone 26 and the annular region 45 may be at least partially controlled by increasing/decreasing the pressure in the annular region 45.

As an example, the tool 20 may be used in gas wells that typically have a large enough amount of positive pressure in the wellbore to induce an adequate flow through test flow path 40. However, the tool 20 may also be used for liquid wells as long as a large enough amount of positive pressure can be created to induce the flow. In these wells (naturally flowing wells), the pressure within the zone 26 is naturally higher than the pressure in the annular region 45 thereby generating the flow through test flow path 40.

Because the tool 20 does not include a pump and because of other features (described below) of the tool 20, the outer diameter of the tool 20 may be small enough to allow the tool 20 to be used in slimhole applications. For example, the tool 20 may be used in borehole that has an inner diameter of approximately 2 to 3 inches (2⅞ inches or 2.25 inches, as examples), in some embodiments of the invention.

The upper 30 and lower 32 packers of the tool 20 each includes an inflatable element (an elastomer bladder, for example) that seals off the annulus between the outer surface of the tool 20 and the interior of the well casing when the packer 30,32 is set. In this manner, the inflatable elements of the packers 30 and 32 respond to pressure that is exerted by fluid that flows through a flow path 60 (formed in the body of the tool 20) of the tool 20. The flow path 60 may extend in parallel to the longitudinal axis of the tool 20 from an inlet port 61 that is located at the top end of the tool 20 to an outlet port 66 that is located near the bottom end of the tool 20. Radial ports 62 and 64 extend to the inflatable elements of the upper 30 and lower 32 packers, respectively; and the port 61 is in fluid communication with the central passageway 63 of the coiled tubing 22. Thus, due to this arrangement, when fluid is circulated through the flow path 60 from the surface of the well, pressure from the fluid is exerted against the inflatable elements of the packers 30 and 32 to inflate the inflatable elements to set the packers 30 and 32.

In other embodiments of the invention, the packer 30,32 may include an element (a compressible element, for example) other than an inflatable element to form an annular seal to set the packer 30,32.

In some embodiments of the invention, (as shown in FIGS. 1 and 3), the tool 20 includes a choke, or flow restrictor 68, in the flow path 60. The flow restrictor 68 increases the circulation pressure of the fluid in the flow path 60, thereby increasing the pressure that the fluid exerts to set the packers 30 and 32. In other embodiments of the invention (as shown in FIG. 2), the flow path 60 does not include the outlet port 66 at the bottom of the tool. Thus, the flow path 60 is sealed off at the bottom.

Among the other features of the tool 20, the tool 20 may include at least one backflow valve, such as a flapper valve 80, that is positioned to block the flow of fluid from the tool 20 up through the central passageway 63 of the coiled tubing 22 and allow flow from the upper side of the valve into the tool 20.

As previously disclosed, the tool 20 (shown in FIGS. 1 and 3) may be used for natural flowing wells. For wells that do not include a naturally flowing zone 26, a tool 100 that is depicted in FIG. 2 may be used. The tool 100 has a similar design to the tool 20 except that the tool includes a radial outlet port 102 in the wall of the coiled tubing 22 below the flapper valve 80. To induce flow in the test flow path 40 of the tool 100, a gas (nitrogen, for example) may be injected into the central passageway of the tubing 22 and circulated into the annular region that surrounds the tubing 22 via the outlet port 102 (the induced flow path). This circulation, in turn, reduces the pressure in annular region 45 thereby inducing a flow into and through the test flow path 40 when the pressure in the annular region 45 is lowered to a reading below the pressure in zone 26. A liquid may alternatively be used to induce flow.

In one embodiment, the same fluid used to inflate the packers 30,32 is used to circulate through outlet port 102. In another embodiment, the fluid used to inflate the packers 30,32 normally remains below the outlet port 102 and is kept under pressure by the fluid being circulated through outlet port 102.

Although designed to induce flow from zone 26, the tool 100 may also be used in naturally flowing wells. Depending on the requirements of the operator and the characteristics of the well and target zone, the operator also has the option of including the flow restrictor 68 and the outlet port 66 in the flow path 60.

It is noted that for each of the embodiments of tool 20, 100, an operator may test different zones within the same wellbore, provided the tool 20, 100 includes multiple sampler chambers. The operator simply tests one zone, and then deflates the packers 30,32, moves the tool to test another zone, and inflates the packers 30,32 to straddle such other zone.

Other embodiments are within the scope of the following claims. For example, instead of being run downhole on coiled tubing, a non-coiled tubing string may be used. Furthermore, the tool 20, 100 may be run downhole on a wireline or a slickline in some embodiments of the invention.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. A tool usable in a subterranean well, comprising:

a test flow path in communication with a zone of the well and a region of the well separate from the zone to use a pressure differential between the zone and the region of the well above the zone to flow well fluid from the zone; and a fluid sampler to sample a composition of the well fluid from the zone, wherein the tool does not comprise a pump to assist the flow of the well fluid through the flow path.

2. The tool of claim 1, wherein the fluid sampler comprises:

a timed sampler.

3. The tool of claim 1, wherein the fluid sampler comprises:

a sampler remotely operable from a surface of the well.

4. The tool of claim 1, further comprising:

packers to seal off corresponding annular regions of the well above and below the zone.

5. The tool of claim 4, wherein at least one of the packers comprises:

an inflatable element to seal off the corresponding annular region.

6. The tool of claim 5, further comprising:

another flow path to circulate another fluid to expand the inflatable element to set said at least one of the packers.

7. The tool of claim 6, wherein said another flow path comprises:

a flow restrictor to increase a pressure of said another fluid exerted on the inflatable element.

8. The tool of claim 1, further comprising:

an equalizing flow path in communication with the region of the well separate from the zone and a region of the well below the zone to equalize the pressure along the length of the tool and thereby prevent the unintended axial movement of the tool.

9. The tool of claim 8, wherein the test flow path and the equalizing flow path are in fluid communication with each other.

10. The tool of claim 8, wherein the test flow path and the equalizing flow path are not in fluid communication with other.

11. The tool of claim 1, wherein the fluid initially comprises a mixture of fluids from parts of the well other than the zone and later includes fluid primarily from the zone, and the sampler delays the sample to allow the mixture to bypass the sampler.

12. The tool of claim 1, further comprising an induced flow path to receive a second fluid from a surface of the well to induce flow of the well fluid through the test flow path.

13. The tool of claim 12, wherein the induced flow path comprises a radial port to establish communication between a central passageway of the tool and an annular region that surrounds the tool.

14. A method usable in a subterranean well, comprising:

flowing fluid in the well from a zone of the well to a region in the well separate from the zone in response to a naturally occurring pressure differential between the region and the zone; and sampling a composition of the well fluid from the zone in response to the flowing.

15. The method of claim 14, further comprising:

providing at least one packer to create the zone and the region separate from the zone.

16. The method of claim 14, wherein the flowing does not include using a pump.

17. The method of claim 14, wherein the sampling comprises:

measuring a time interval from a beginning of the flow of well fluid from the zone; and sampling after the expiration of the time interval.

18. The method of claim 14, wherein the sampling comprises:

remotely communicating with a sampler downhole to sample the well fluid from the zone.

19. The method of claim 14, further comprising:

inflating at least one packer to create the zone and the region.

20. The method of claim 19, wherein the inflating comprises:

flowing another fluid downhole to create a pressure to inflate said at least one packer.

21. The method of claim 20, wherein the flowing said another fluid comprises:

using a flow restrictor in a flow path of said another fluid to increase the pressure.

* * * * *